US005113645A

United States Patent [19]

Hauers et al.

[11] Patent Number: 5,113,645

[45] Date of Patent: May 19, 1992

[54] TEXTILE MACHINE SERVICE UNIT HAVING A ROVING END EXTENDING APPARATUS

[75] Inventors: Manfred Hauers, Viersen; Dieter Vits, Neuss, both of Fed. Rep. of Germany

[73] Assignee: Zinser Textilmaschinen GmbH, Ebersbach/Fils, Fed. Rep. of Germany

[21] Appl. No.: 508,054

[22] Filed: Apr. 11, 1990

[30] Foreign Application Priority Data

Apr. 11, 1989 [DE] Fed. Rep. of Germany ..... 3911765

[51] Int. Cl.[5] ..... D01H 9/10; D01H 9/14

[52] U.S. Cl. ..... 57/269; 57/261; 57/266; 57/268; 57/271; 57/273; 57/278; 57/281

[58] Field of Search ..... 57/90, 281, 261, 266, 57/268-269, 271, 273, 278-279

[56] References Cited

U.S. PATENT DOCUMENTS

| | | | |
|---|---|---|---|
| 4,080,776 | 3/1978 | Hemala et al. | 57/278 |
| 4,233,810 | 11/1980 | Kamp | 57/275 X |
| 4,899,531 | 2/1990 | Mack | 57/281 |
| 4,944,146 | 7/1990 | Scaglia | 57/90 X |
| 4,979,360 | 12/1990 | Kallmann et al. | 57/281 |

FOREIGN PATENT DOCUMENTS

| | | | |
|---|---|---|---|
| 0213962 | 3/1987 | European Pat. Off. . | |
| 0310871 | 4/1989 | European Pat. Off. | 57/281 |
| 2230801 | 1/1974 | Fed. Rep. of Germany . | |
| 3537727A1 | 5/1986 | Fed. Rep. of Germany . | |
| 3734275A1 | 4/1989 | Fed. Rep. of Germany . | |
| 0071432 | 4/1984 | Japan | 57/261 |
| 1-192837 | 8/1989 | Japan | 57/281 |

*Primary Examiner*—Daniel P. Stodola
*Assistant Examiner*—William Strysewski
*Attorney, Agent, or Firm*—Shefte, Pinckney & Sawyer

[57] ABSTRACT

A bobbin exchange apparatus for exchanging full bobbins for empty bobbins on a spinning machine. A bobbin exchange apparatus is mounted in a traveling service unit and includes a component for temporarily supporting a bobbin, a component for transferring a bobbin between and among the creel and the spare bobbin frame of the textile machine and the traveling service unit, and a component for displacing the end of the roving of a full bobbin temporarily supported on the temporary supporting device to an extending disposition ready for engagement for feeding to the drafting device of the textile machine. A suction applying device for applying the suction to engage the roving end is pivotally mounted to the temporary supporting component for pivoting about an axis parallel and offset from the axis of the temporarily supported full roving bobbin. An intermediate engaging member mounted to the temporary supporting component for pivoting about the axis of the full roving bobbin includes a hook end portion for engaging the roving end. The suction applying device and the intermediate engaging member are synchronously pivoted in opposite pivoting directions to effect alignment of the roving end of the full roving bobbin for gripping by a roving feeder gripper. The roving feeder gripper subsequently pieces the gripped roving end with the roving of a nearly exhausted roving bobbin.

15 Claims, 3 Drawing Sheets

TEXTILE MACHINE SERVICE UNIT HAVING A ROVING END EXTENDING APPARATUS

BACKGROUND OF THE INVENTION

The present invention relates to a traveling service unit of a textile machine for transferring full and empty bobbins and having an apparatus for extending the roving end of the full bobbin to an extending disposition ready for engagement for feeding to a drafting apparatus of the textile machine.

In European Patent Application No. 0 213 962, a traveling service unit for a textile machine is disclosed which includes a pair of vertically and laterally positionable bobbin transfer members for transferring bobbins between a spare bobbin frame on which full bobbins are supported and a bobbin holder on which bobbins are supported during the drawing of roving therefrom by drafting apparatus. The service unit additionally includes means for applying suction to the roving end of a full bobbin to engage the roving end for transfer to a ready position at which a grasping device can engage the roving end to transfer the roving end for a piecing operation with the roving end of the bobbin currently feeding the drafting apparatus.

However, the need still exists for a traveling service unit which reliably and accurately positions the roving end of a full bobbin for feeding to a drafting apparatus of a textile machine.

SUMMARY OF THE INVENTION

The present invention relates to an apparatus for a traveling service unit of a textile spinning machine for positioning the roving end of a full bobbin in a disposition for engagement for feeding to the drafting apparatus of a textile machine.

Briefly described, the present invention provides an apparatus for exchanging full and empty bobbins of a textile spinning machine of the type having a bobbin holder for holding a bobbin during the drawing of roving therefrom by a drafting apparatus and a spare bobbin frame for supporting a full bobbin. The apparatus is mounted on the traveling service unit for exchanging a full bobbin supported on the spare bobbin frame for a bobbin supported on the bobbin holder and includes means for temporarily supporting a bobbin and means for transferring a bobbin between the bobbin holder, the spare bobbin frame and the temporarily supporting means, the transferring means being operable to sequentially transfer a full bobbin from the spare bobbin frame to the temporarily supporting means and from the temporarily supporting means to the bobbin holder and to sequentially transfer a bobbin from the bobbin holder to the spare bobbin frame. Additionally, the apparatus includes means for displacing the end of the roving of the full bobbin from the bobbin to an extending disposition ready for engagement for feeding to the drafting apparatus.

According to one aspect of the present invention, the transferring means preferably includes a bobbin receiving means having a vertical post for receiving the tube of a bobbin inserted thereon and translational movement means for moving the bobbin receiving means to effect translational movement of a bobbin inserted on the vertical post between the bobbin holder, the spare bobbin frame and the temporarily supporting means. Additionally, the apparatus preferably includes means for gripping the roving end of the full bobbin when the roving end is in the extending disposition for manipulating the roving end into feeding engagement with the roving of a bobbin which is feeding roving to the drafting apparatus.

According to a further aspect of the present invention, the gripping means is preferably pivotally mounted to the transferring means for pivoting laterally of the service unit toward and away from the textile spinning machine. Furthermore, the displacing means preferably includes means for applying a suction to the roving end of the full bobbin, the suction applying means including a suction opening for entry of the roving end therein.

For a bobbin exchange wherein the full bobbin is formed on a tube having top and bottom portions, the temporarily supporting means preferably includes post means for receiving the top portion of the tube of the full bobbin thereon, the temporarily supporting means being operable to support the bobbin in suspended disposition from the post means. Additionally, the displacing means preferably includes means for selectively pivoting the suction applying means about a pivot axis offset from, and parallel to, the axis of the post means, the suction applying means being pivotable to move the suction opening between an initial position and a feeding engagement position more radially displaced from the full bobbin than the initial position relative to the post means axis.

In the preferred embodiment, the suction applying means extends in a generally radial direction relative to the suction applying means pivot axis from the temporarily supporting means and extends from the suction opening in a generally axial direction relative to the suction applying means pivot axis.

According to a further additional aspect of the present invention, the displacing means includes a roving end intermediate engaging member connected to the temporarily supporting means and positionable radially intermediate the full bobbin and the suction applying means in the feeding engagement position thereof for engaging the roving of the full bobbin in the extending disposition. According to another aspect of the present invention, the roving end intermediate engaging member is pivotally supported on the temporary supporting means and the displacing means includes means for selectively pivoting the roving end intermediate engaging member about the post means axis between an initial position and a feeding engaging position in which the roving end intermediate engaging member engages the roving of the full bobbin in the extending disposition. Preferably, a selected one of the suction applying means and the roving and intermediate engaging member is pivotable about its respective axis in one direction from its initial position to its feeding engagement position and the other of the suction applying means and the roving end intermediate engaging member is pivotable about its respective axis in the opposite direction from its initial position to its feeding engagement position.

In a further aspect of the present invention, the apparatus includes synchronous movement means for synchronously moving the suction applying means and the roving end intermediate engaging member in their respective directions to effect coordinated engagement of the roving of the full bobbin by the suction applying means and the roving end intermediate engaging member. The synchronous movement means preferably includes a first gear fixedly connected to the suction applying means and rotatably supported on the temporarily supporting means coaxial to the suction applying means axis and a second gear fixedly connected to the roving end intermediate engaging member and rotatably supported on the temporarily supporting means coaxial to the roving end intermediate engaging member axis, the first and second gears being in meshing engagement with one another. Additionally, the synchronous movement means includes means for rotatably driving a selected one of the first and second gears to effect synchronous movement of the suction applying means and the roving end intermediate engaging member.

According to another aspect of the present invention, the temporarily supporting means includes means for temporarily supporting a second bobbin, the means including a post member for receiving the second bobbin thereon and means for vertically moving a bobbin temporarily supported thereon.

DETAILED DESCRIPTION OF THE PREFERRED EMBODIMENT

Figure 1:
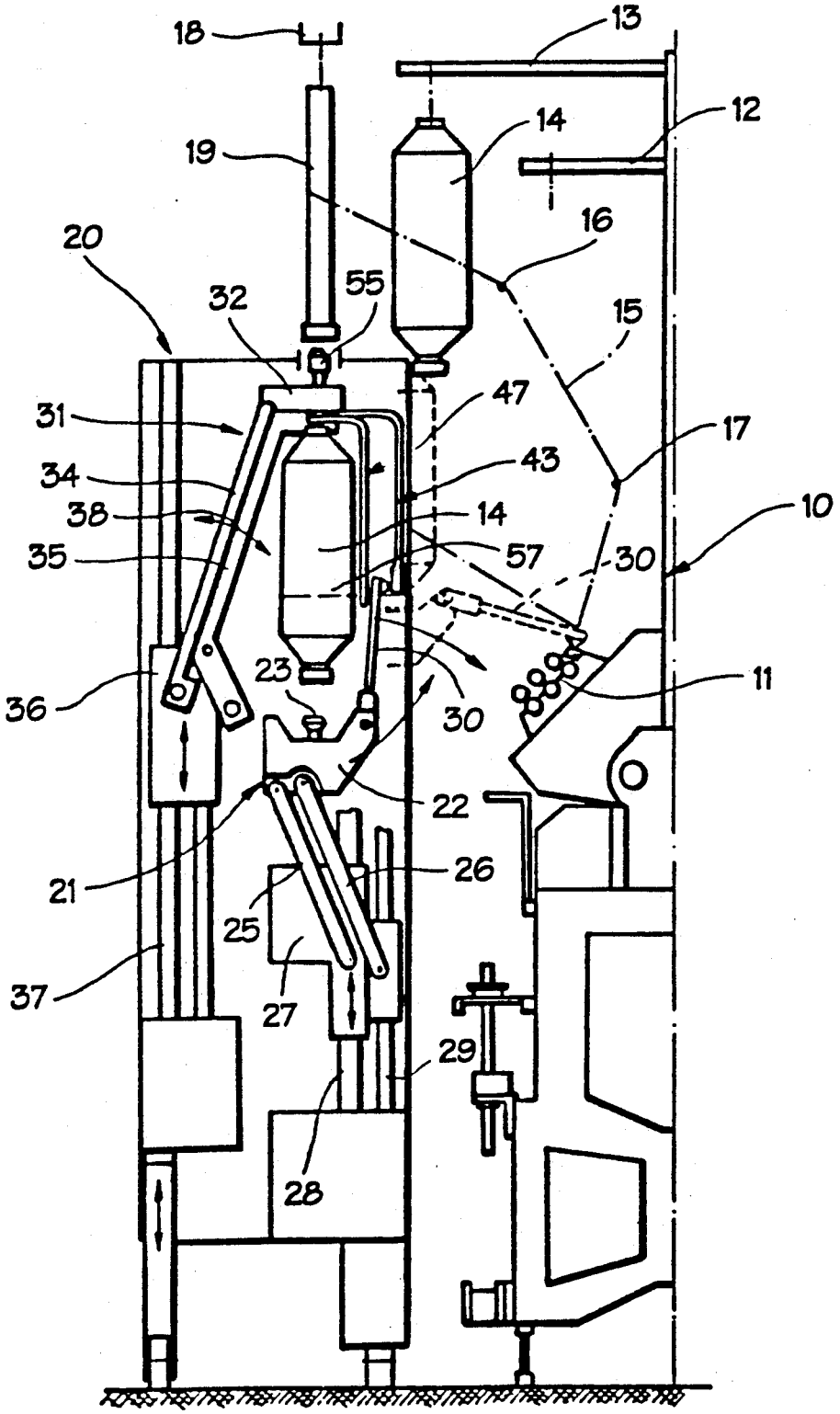
FIG. 1 is a front elevational view of a spinning station of a textile spinning machine and a traveling service unit for performing a bobbin exchange operation at the spinning station, a portion of the traveling service unit being cut away to show the preferred embodiment of the bobbin exchange apparatus of the present invention.

FIGS. 1–4, the preferred embodiment of the bobbin exchange apparatus of the present invention is illustrated. A conventional ring spinning machine 10 having a plurality of spinning stations disposed uniformly along each side thereof includes an inner bobbin creel 12 and an outer bobbin creel 13. The bobbin creels 12, 13 support a plurality of roving bobbins for the drawing of roving therefrom by the drafting devices 11 of the individual spinning stations. The roving drawn from each bobbin is drawn through a pair of conventional roving guides 16, 17 during its travel to the drafting device 11.

The ring spinning machine 10 additionally includes a spare bobbin frame 18 for supporting a supply of fresh full roving bobbins 14 and a plurality of empty roving bobbins 19 which have already been transferred from the creels 12, 13 laterally outward of the roving bobbins supported on the creels 12, 13. A traveling service unit 20 travels in conventional manner in a direction parallel to the row of spinning stations to individually service the spinning stations. The traveling service unit 20 is provided with the bobbin exchange apparatus of the present invention for exchanging full bobbins supported on the spare bobbin frame 18 for bobbins supported on the creels 12, 13. The bobbin exchange apparatus includes a means 31 for temporarily supporting a bobbin and a means 21 for transferring a bobbin between and among a selected one of the creels 12, 13, the spare bobbin frame 18, and the temporarily supporting means 31. The bobbin exchange apparatus additionally includes a means for displacing the end of the roving of a full bobbin from the bobbin to an extending disposition ready for engagement for feeding to the drafting apparatus 11.

The transferring means 21 includes a pair of vertically extending guide shafts 28 fixedly mounted to the frame of the traveling service unit 20. A carrier assembly 27 includes a pair of portions, each slidably movably disposed on a respective one of the guide shafts 28, and conventional means for slidably moving the carrier assembly 27 vertically along the guide shafts 28. One free end of each of a pair of pivot arms 25, 26 is pivotally connected to a respective one of the sliding portions of the carrier assembly 27 and the other free end of each respective pivot arm 25, 26 is pivotally connected to a platform member 22. The pivot arms 25, 26 are pivotally movable relative to the carrier assembly 27 by conventional pivoting means (not shown).

Figure 2:
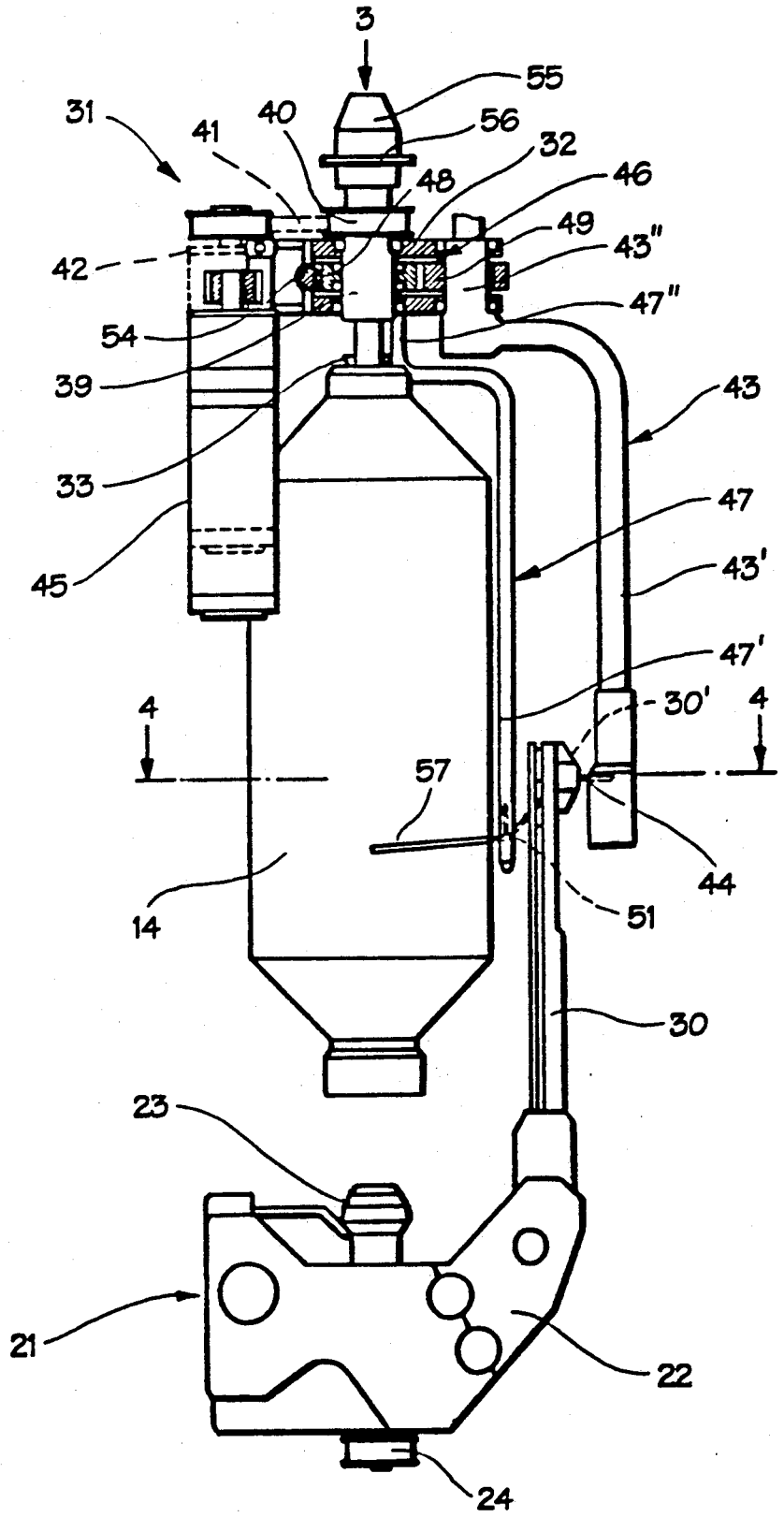
FIG. 2 is an enlarged front elevational view, in partial vertical section, of a portion of the bobbin exchange apparatus shown in FIG. 1.

A post member 23 is rotatably supported on the platform member 22 and is compatibly configured, as best seen in FIG. 2, with the inner diameter of a roving bobbin for receiving a bobbin thereon. The post member 23 additionally includes a conventional stabilizing means to releasably secure a roving bobbin inserted thereon. A pulley 24 is coaxially fixedly mounted to the post member 23 and a pulley belt is trained around the pulley 24 and the drive pulley of a conventional drive means (not shown) for driving rotation of the post member 23 about its axis by the drive means. Through the vertical movement of the carrier assembly 27 along the guide shafts 28 and the pivoting of the pivot arms 25, 26 relative to the carrier assembly 27 and the platform member 22, the post member 23 is movable upwardly and downwardly and laterally toward and away from the spinning station 11.

Figure 3:
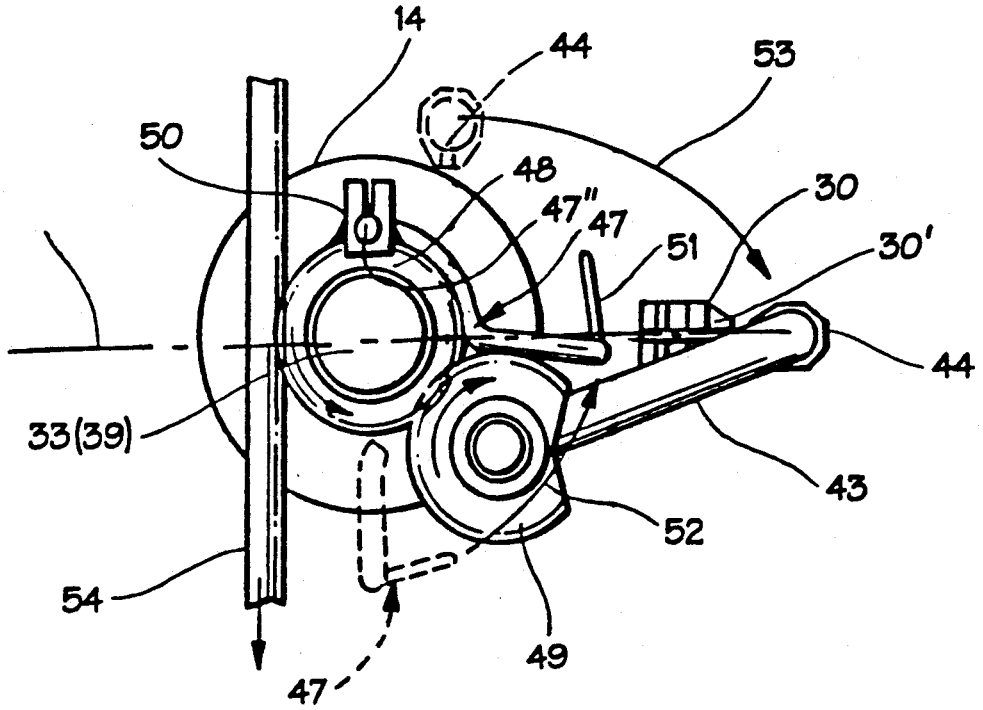
FIG. 3 is a top plan view of the portion of the bobbin exchange apparatus illustrated in partial vertical section in FIG. 2.
Figure 4:
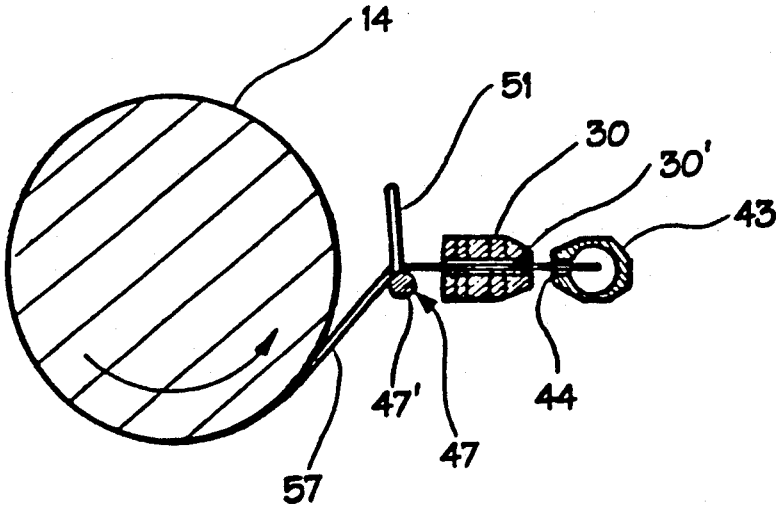
FIG. 4 is a plan sectional view of the portion of the bobbin exchange apparatus shown in FIG. 3, taken along lines IV—IV thereof.

A roving feeding gripper 30 is pivotally mounted to the platform member 22 and includes, as best seen in FIGS. 3 and 4, a guide slot 30' for receiving the roving end 57 of a full roving bobbin 14 supported on the temporarily supporting means 31. The roving feeder gripper 30 includes a pair of gripper jaws movable toward and away from one another to selectively grip a roving end 57 received in the guide slot 30'.

The temporarily supporting means 31 includes a pair of vertical guide shafts 37 fixedly mounted to the frame of the traveling service unit 20 and a carrier assembly 36 slidably supported on the cylindrical shafts 37 and including conventional drive means (not shown) for vertically driving the carrier assembly 36 along the guide shafts 37. As best seen in FIG. 1, the free end of a pair of pivot arms 34, 35 are pivotally connected to the carrier assembly 36 for pivoting relative thereto and the other free ends of the pivot arms are pivotally connected to a platform member 32. The pivot arms 34, 35 are pivotable in the direction indicated by the arrow 38 in FIG. 1 by a conventional pivot drive means (not shown) to move the platform member 32 laterally toward and away from the spinning stations 11.

As best seen in FIG. 2, the temporarily supporting means 31 additionally includes a post member 33 having a shaft portion 39 rotatably supported on the platform member 32 and a roving bobbin receiving portion extending vertically downwardly therefrom for supporting a roving bobbin inserted thereon. A pulley 40 is coaxially fixedly mounted to the shaft portion 39. A pulley belt 41 is trained around the pulley 40 and the drive pulley of a conventional drive means 42 mounted on the platform member 32 for driving rotation of a roving bobbin mounted to the post member 33.

The temporarily supporting means 31 additionally includes a second post member 55 coaxially fixedly mounted to the shaft portion 39 for rotation therewith and extending vertically upwardly beyond the shaft 39 for supporting a roving bobbin inserted thereon. The second post member 55 includes a limit ring 56 coaxially fixedly mounted thereto for engagement with the base of a roving bobbin to stabilize the roving bobbin in a supported disposition on the second post member 55.

The displacing means includes a suction applying means 43. The suction applying means 43 includes a suction end 44 for applying suction to a roving end 57 of a full bobbin temporarily supported on the post member 33. The suction end 44 is mounted on a conduit 43' which is rotatably supported on the platform member 32 by conventional bearing assemblies. The conduit 43' is communicated with a conventional vacuum source (not shown) mounted on the traveling service unit 20 for applying a suction through the suction end 44. Additionally, the displacing means includes a roving end intermediate engaging member 47 rotatably supported on the platform member 32 by conventional ball bearing assemblies.

The suction conduit 43' includes a vertical portion 43'' rotatably received in the platform member 32 and defining the suction applying means axis about which the suction applying means 43 is pivoted relative to the platform member 32, a radially extending portion extending radially from the suction applying means axis and an axially extending portion extending from the radially extending portion to the suction end 44. A gear 49 is coaxially fixedly mounted to the vertical portion 43''.

The roving end intermediate engaging member 47 includes an axial portion 47'', as best seen in FIG. 3, which is mounted via a mounting member 50 to a gear 48 coaxially fixedly mounted to the shaft portion 39 of the post member 33 for rotatably supporting the roving end intermediate engaging member 47 on the platform member 32 for selective pivoting of the roving end intermediate engaging member 47 about the axis of the post member 33. The roving end intermediate engaging member 47 additionally includes a radially extending portion extending radially from the axial portion 47'' with respect to the axis of the post member 33 and an axially extending portion 47' extending axially from the radially extending portion and terminating at a hook end member 51.

As best seen in FIG. 3, the radially extending portion of the roving end intermediate engaging member 47 extends radially with respect to the axis of the post member 33 to an extent sufficient to dispose the axial portion 47' radially outwardly from the circumference of a full roving bobbin 14 supported on the post member 33. The hook end member 51 extends generally tangentially with respect to a full roving bobbin 14 supported on the post member 33.

The gear 48 is rotatably driven by a conventional gear drive means 45 and the gears 48, 49 meshingly engage with one another to transmit rotation of the gear 48 to the gear 49.

The operation of the bobbin exchange apparatus is as follows. The traveling service unit 20 is positioned adjacent a spinning station of the ring spinning machine 10 to perform a bobbin exchange operation thereat. The roving bobbin supported on one of the creels 12, 13 may be a roving bobbin which is currently supplying roving to the drafting device 11 of the spinning station or may be an empty roving bobbin, its supply of roving having been fully drawn off. Initially, the transferring means 21 is operated to vertically and laterally manipulate the post member 23 to effect insertion of the post member into a full roving bobbin 14 supported on the spare bobbin frame 18. If necessary, the pivot arms 34, 35 of the temporarily supporting means 31 are manipulated to clear the temporarily supporting mean 31 from the path of travel of the transferring means 21. The full roving bobbin 14 engaged by the post member 23 is vertically raised in conventional manner to effect removal of the full roving bobbin from the spare bobbin frame 18 and the carrier assembly 27 of the transferring means 21 is subsequently downwardly moved to effect lowering of the full roving bobbin 14 which is now supported entirely by the post member 23.

The transferring means 21 is sufficiently lowered to permit lateral movement of the platform member 32 of the temporarily supporting means 31 over the top of the supported full roving bobbin 14. Accordingly, the platform member 32 is then disposed over the top of the supported full roving bobbin 14 with its post member 33 in axial alignment with the full roving bobbin through appropriate manipulation of the pivot arms 34, 35. Thereafter, the carrier assembly 27 of the transferring means 21 is operated to raise the supported full roving bobbin 14 to effect insertion of the top of the full roving bobbin onto the post member 33 for supporting engagement thereby. The transferring means 21 is then lowered to the position shown in FIG. 1 to effect removal of the post member 23 from the bottom of the full roving bobbin 14, which is now fully supported by the post member 33 on the temporarily supporting means 31.

If the roving from the roving bobbin which is currently feeding to the drafting device 11 has not yet been completely drawn off from the roving bobbin, the transferring means 21 is operated in correspondence with the completion of the drawing off of the roving to position the post member 23 for insertion into the bottom of the roving bobbin to effect removal of the bobbin from the creel 12, 13 from which it is supported. Otherwise, if the roving bobbin or the creel 12, 13 is empty, the transferring means 21 is operated in the same manner to position the post member 23. The transferring means 21 raises the feed bobbin in conventional manner to effect disengagement of the top of the bobbin from its supported engagement by the creel 12, 13. Thereafter, the now empty roving bobbin, which is completely supported on the post member 23 of the transferring means 21, is moved laterally outwardly with respect to the spinning station to position the empty roving bobbin, designated as 19 in FIG. 1, for supporting engagement by the spare bobbin frame 18. In correspondence with this lateral and vertical movement of the transferring means 21, the pivot arms 34, 35 of the temporarily supporting means 31 are appropriately manipulated to move the full bobbin 14 supported on the temporarily supporting means 31 laterally outwardly with respect to the spinning station out of interference with the travel of the transfer means 21. Once the transfer means 21 has aligned the empty bobbin 19 with an empty engaging member on the spare bobbin frame 18, the transferring means 21 is operated to raise the empty roving bobbin 19 to insert the roving bobbin onto the spare bobbin frame 18. Subsequently, the transfer means 21 is lowered to effect removal of the post member 23 from the bottom of the empty roving 19.

In correspondence with the transfer of the empty roving bobbin 19 to the spare bobbin frame 18, the displacing means is operated to position the roving end 57 of the full roving bobbin 14 in an extending disposition ready for engagement for feeding to the drafting device 11. In this regard, the suction applying means 43 and the roving end intermediate engaging member 47 are initially disposed in respective initial positions shown in the broken lines in FIG. 3. In the initial position of the suction applying means 43, the suction end 44 is positioned relatively closely adjacent the circumference of the full roving bobbin 14. In its initial position, the roving end intermediate engaging member 47 is angularly displaced from the guide slot 30' relative to the axis of the post member 33. The suction end 44 is disposed at a height relative to the full roving bobbin 14 generally at a predetermined axial extent of the full roving bobbin in which the roving end 57 has preferably been disposed during a prior preparatory step. For example, the roving end 57 of each of the full roving bobbins supported on the spare bobbin frame 18 may each have undergone a roving end disposition step in which their roving ends were disposed in the lower axial third of the bobbin.

In correspondence with the start of the roving end engagement by the bobbin exchange apparatus, the transfer means 21 is lowered via appropriate operation of the carrier assembly 27 to position the roving feeder gripper 30 vertically below the level of the hooked end 51 and the suction end 44.

With the suction end 44 in the initial position of the suction applying means 43, the drive means 42 is operated to drive the pulley belt 41 to thereby effect rotation of the full roving bobbin 14 via rotation of the pulley 40 and the post means 33. As the full roving bobbin 14 is rotated in an unwinding direction (a counterclockwise direction as viewed in FIG. 3 and 4), a suction is applied through the suction end 44 to engage the roving end 57, which is preferably at the same vertical location as the suction end 44.

In correspondence with the engagement of the roving end 57 by the suction end 44, the drive means 45 is operated to effect synchronous movement of the suction applying means 43 and a roving end intermediate engaging member 47 from their respective initial positions to their respective feeding engagement positions. As best seen in FIG. 3, the gear 48 mounted to the roving end intermediate engaging member 47 is rotated in one direction (the counterclockwise direction in FIG. 3) and this rotation of the gear 48 effects rotation of the gear 49 mounted to the suction applying means 43, in the opposite rotational direction (the clockwise direction as viewed in FIG. 3). Since the axis about which the suction applying means 43 pivots (the axis of its axial portion 43'') is offset radially from the axis of the post member 33, the pivoting of the suction applying means 43 from its initial position to its feeding engagement position acts to move the roving end 57, which is continuously engaged by the suction end 44 through the suction applied therethrough, to a position more radially displaced from the circumference of the full roving bobbin 14 than the position of the roving end when it is engaged by the suction end 44 in the initial position of the suction applying means 43. This positioning of the roving end 47 follows due to the path of travel of the suction end 44 as schematically shown in FIG. 3, from the broken line initial position of the suction end adjacent the circumference of the full roving bobbin to the solid line position of the suction end shown in FIG. 3. Due to the synchronous movement of the suction applying means 43 and the roving end intermediate engaging member 47, the hook end member 51 engages the roving end 57 at a position thereon intermediate the portion of the roving end engaged by the suction end 44 and the portion of the roving end still disposed on the circumference of the full roving bobbin 14 and maintains engagement with the roving end 57 as the roving end intermediate engaging member 47 completes its movement from its initial position to its feeding engaging position, shown in the solid line in FIG. 3. The gear ratios of the gears 48 and 49 is preferably selected such that the respective feeding engagement positions in which the suction applying means 43 and the roving end intermediate engaging member 47 are disposed at the completion of their pivoting are generally in alignment with one another along a feeding radius FR relative to the axis of the post member 33. Accordingly, the roving end 57, as best seen in FIG. 4, extends linearly along the feeding radius FR between the suction end 44 and the hook end member 51 when the suction applying means 43 and the roving end intermediate engaging member 47 are in their respective feeding engagement positions.

In correspondence with the movement of the suction applying means 43 and the roving end intermediate engaging member 47 into their respective feeding engagement positions, the carrier assembly 27 of the transfer means 21 is raised to effect movement of the roving feeder gripper 30 into its roving end receipt position radially intermediate the suction end 44 and the hook end member 51. As the roving feeder gripper 30 is raised, its guide slot 30', which is aligned with the feeding radius FR, receives the roving end 57 therein. As seen in FIG. 2, the guide slot 30' curves downwardly as measured along the feeding radius FR in the direction from the suction end 44 toward the hook end member 51 and then inclines at a generally constant slope from its initial curved portion to its side adjacent the hook end member 51. This contour of the guide slot 30' insures that the roving end 57 is securely seated within the guide slot. Since the portion of the roving end 57 between the suction end 44 and the hook end member 51 extends at a downward inclination at a relatively constant slope, this portion of the roving end is securely engaged by the guide slot 30' during the upward movement of the roving feeder gripper 30 intermediate the suction end 44 and the hook end member 51. The gripper jaws of the roving feeder gripper 30 are operated to securely clamp the roving end therebetween when the roving end is received in the guide slot 30'.

With the roving end 57 of the full roving bobbin 14 now securely gripped by the roving feeder gripper 30 of the transfer means 21, the transfer means 21 is raised to effect insertion of the bottom of the full roving bobbin 14 onto the post member 23 for supporting engagement of the full roving bobbin by the transfer means 21 and, simultaneously, to effect disengagement of the top of the full roving bobbin from the post means 33. With the full roving bobbin 14 now completely supported by the transfer means 21, the suction applying means 43 and the roving end intermediate engaging member 47 are preferably moved via synchronous rotation of the gears 48, 49 from their respective feeding engagement positions to their initial positions and thereby out of interference with subsequent lateral movement of the transfer means 21 toward the spinning station. Through appropriate pivoting of the pivot arms 25, 26 relative to the carrier assembly 27, the platform member 22 of the transfer means 21 is thereafter moved laterally in a direction from the traveling service unit 20 toward the spinning station and the carrier assembly 27 is raised along the guide shaft 28 to effect movement of the full roving bobbin 14 to the position shown in the broken lines in FIG. 1. In this position, the roving feeder gripper 30 is pivoted relative to the platform member 22 to the broken line position shown in FIG. 1 to position the roving end 57 at the guide slot 30' in piecing engagement with the roving 15 being drawn from the nearly completely exhausted roving of the roving bobbin 19 supported at the spare bobbin frame 18. The roving of the full roving bobbin 14 is then pieced in conventional manner with the roving 15 and the roving 15 is then subsequently severed from the roving of the full roving bobbin for drawing of the roving from the full roving bobbin 14 by the drafting device 11. If the roving on the roving bobbin 19 has been completely exhausted prior to this piecing step, the roving from the full roving bobbin 14 is fed in conventional manner directly to the drafting device 11 for drawing of the roving from the full roving bobbin 14 by the drafting device 11. Following the feeding of the roving from the full roving bobbin to the drafting device 11, the transfer means 21 is operated to raise the full roving bobbin 14 from the broken line position shown in FIG. 1 to its supported position, representatively shown by solid lines in FIG. 1, on a selected one of the creels 12, 13. The full roving bobbin 14 is transferred to the bobbin support member of the selected creel 12, 13 through appropriate vertical movement of the transfer means 21 and the post member 23 is disengaged from the bottom of the full roving bobbin 14 during downward movement of the transfer means 21. In coordination with this transfer of the full roving bobbin 14 to the selected creel 12, 13, the roving feeder gripper 30 is manipulated to position the roving feeding from the full roving bobbin 14 to the drafting device 11 in the roving guides 16, 17.

If the roving 15 which has been drawn off from the roving bobbin 19 prior to severing of the roving 15 from the roving from the full bobbin 14 remains, the temporarily supporting means 31 is raised via appropriate operation of the carrier assembly 36 to effect insertion of the second post member 55 into the bottom of the roving bobbin 19. Then, the drive means 42 is operated to effect rotation of the second post member 56 via the pulley 41 and the pulley 40 to rotate the roving bobbin 19 in a winding direction to wind the drawn-off extent of the roving 15. If desired, the platform member 32 of the temporarily supporting means 31 can be provided with a conventional yarn end positioning means (not shown) such as, for example, a brush-type yarn end positioning means, for disposing the end of the roving 15 in the preferred disposition on the roving bobbin 19. The roving bobbin 19 is then ready for transport by the spare bobbin frame 18 to a further handling location.

According to another aspect of the present invention, the temporarily supporting means 31, the transfer means 21 and the displacing means can be configured to simultaneously handle the bobbin exchange operations at several adjacent spinning stations. In this regard, the temporarily supporting means 31 can be provided with a plurality of the post members 33, the second post members 55, the suction applying means 43, the roving end intermediate engaging member 47 appropriately spaced relative to the spacing of the spinning stations along the side of the ring spinning machine 10. In this regard, the pulley belt 41 can be entrained around the several pulleys 40 so that the post members 33 and the second post members 55 can be commonly driven by the drive means 42. Likewise, common drive of the several suction applying means 43 and the several roving end intermediate engaging members 47 can be effected through a common drive shaft 54, seen in FIGS. 2 and 3, which is configured as a conventional gear rack extending longitudinally and in meshing engagement with each respective gear 48. The common drive shaft 54 is operatively connected in conventional manner to the drive means 45 for driving of the shaft longitudinally to effect simultaneous pivoting of the several gears 48.

As seen in FIGS. 2 and 4, the hook end member 51 includes a portion extending transversely from the axial portion 47' of the roving end intermediate engaging member 47 at a location axially inwardly spaced from the bottom of the axial portion 47'. Accordingly, the portion of the roving end 57 engaged by the hook end member 51 slides along the underside of the extending portion of the hook end member and comes to rest at the junction formed by the extending portion of the hook end member 51 at its junction with the axial portion 47'. The relative vertical height of this junction and the suction end 44 insures that the portion of the roving end 57 extending between these two locations extends at a downward inclination of generally constant slope in the direction from the suction end 44 to the hook end member 51.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a traveling service unit of a textile spinning machine, the textile spinning machine being of the type having a bobbin holder for holding a bobbin during the drawing of roving therefrom by a drafting apparatus and a spare bobbin frame for supporting thereon a full bobbin having an axis, an apparatus on the traveling service unit for exchanging a full bobbin supported on the spare bobbin frame for a bobbin supported on the bobbin holder, comprising:

means for temporarily supporting a bobbin, said temporarily supporting means including means for rotating a bobbin supported thereon about an axis of the bobbin in the same respective angular direction relative to the bobbin axis in which roving is unwound from the bobbin;

means for sequentially transferring a bobbin between the bobbin holder, the spare bobbin frame and said temporarily supporting means, said sequentially transferring means being operable to sequentially transfer a full bobbin from the spare bobbin frame to said temporarily supporting means, a bobbin from the bobbin holder to the spare bobbin frame and the full bobbin supported on said temporarily supporting means to the bobbin holder;

means for positioning an end of the roving of the full bobbin in a preferred gripping ready position, said preferred gripping ready position being a linear path along which said roving end extends linearly for ready gripping of said roving end thereat in preparation for subsequent feeding engagement of said roving end, said positioning means including means for applying a suction to said roving end during unwinding rotation of the full bobbin by said temporarily supporting means, said suction applying means having a suction opening positionable at a location outward of said full bobbin for entry of said roving end therein, and a roving end intermediate engaging member positionable for engaging said roving end at a location intermediate the full bobbin and said suction opening of said suction applying means, said suction applying means and said roving end intermediate engaging member being operable in coordination with one another to support said roving end portion as it is extending linearly in said linear path between said roving end intermediate engaging member and said suction opening of said suction applying means, said suction applying means being movably mounted to the traveling service unit for movement between an initial position in which said suction applying means applies suction to the full bobbin to engage said roving end thereof and a feeding engagement position in which said suction applying means is disposed relative to said initial position of said suction applying means such that said roving end, when it has been engaged by said suction applying means, is moved from the full bobbin in the unwinding direction during movement of said suction applying means from said initial position to said feeding engagement position, said roving end intermediate engaging member being movable between a start position and a finish position, said start position of said roving end intermediate engaging member being at a greater angular displacement from said initial position of said suction applying means than the angular displacement of said finish position of said roving end intermediate engaging member from said initial position of said suction applying means, as measured relative to the axis of the full bobbin, and synchronous movement means for synchronously moving said suction applying means from said initial position to said feeding engagement position and said roving end intermediate engaging member from said start position to said finish position to effect coordinated engagement of said roving end of the full bobbin by said suction applying means and said roving end intermediate engaging member; and means for gripping said roving end at said preferred gripping ready position for manipulating said roving end into feeding engagement with a bobbin supported on the bobbin holder.

2. In a traveling service unit, the apparatus according to claim 1 and characterized further in that said sequentially transferring means includes a bobbin receiving means having a vertical post for receiving the tube of a bobbin inserted thereon and translational movement means for moving said bobbin receiving means to effect translational movement of a bobbin inserted on said vertical post between the bobbin holder, the spare bobbin frame and said temporarily supporting means.

3. In a traveling service unit, the apparatus according to claim 2 and characterized further by means for gripping said roving end of said full bobbin when said roving end is in said extending disposition for manipulating said roving end into feeding engagement with the roving of a bobbin which is feeding roving to the drafting apparatus.

4. In a traveling service unit, the apparatus according to claim 3 and characterized further in that said gripping means is pivotally mounted to said transferring means for pivoting laterally of the service unit toward and away from the textile spinning machine.

5. In a traveling service unit, the apparatus according to claim 1 wherein said full bobbin is formed on a tube having top and bottom portions and characterized further in that said temporarily supporting means includes post means for receiving the top portion of the tube of said full bobbin thereon, said temporarily supporting means being operable to support said bobbin in suspended disposition from said post means.

6. In a traveling service unit, the apparatus according to claim 5 and characterized further in that said means for positioning an end of the roving of the full bobbin includes means for selectively pivoting said suction applying means about a pivot axis offset from, and parallel to, the axis of said post means, said suction applying means being pivotable to move said suction opening between an initial position and a feeding engagement position more radially displaced from said full bobbin than said initial position relative to said post means axis.

7. In a traveling service unit, the apparatus according to claim 6 and characterized further in that said suction applying means extends in a generally radial direction relative to said suction applying means pivot axis from said temporarily supporting means and extends from said suction opening in a generally axial direction relative to said suction applying means pivot axis.

8. In a traveling service unit, the apparatus according to claim 5 and characterized further in that said roving end intermediate engaging member is pivotally supported on said temporary supporting means and said means for positioning an end of the roving of the full bobbin includes means for selectively pivoting said roving end intermediate engaging member about said post means axis between an initial position and a feeding engaging position in which said roving end intermediate engaging member engages said roving of said full bobbin in said extending disposition.

9. In a traveling service unit, the apparatus according to claim 8 and characterized further in that a selected one of said suction applying means and said roving and intermediate engaging member is pivotable about its respective axis in a one direction from its initial position to its feeding engagement position and the other of said suction applying means and said roving end intermediate engaging member is pivotable about its respective axis in a the opposite direction from its start position to its finish position.

10. In a traveling service unit, the apparatus according to claim 9 and characterized further by synchronous movement means for synchronously moving said suction applying means and said roving end intermediate engaging member in their respective directions to effect coordinated engagement of said roving of said full bobbin by said suction applying means and said roving end intermediate engaging member.

11. In a traveling service unit, the apparatus according to claim 10 and characterized further in that said synchronous movement means includes a first gear fixedly connected to said suction applying means and rotatably supported on said temporarily supporting means coaxial to said suction applying means axis, a second gear fixedly connected to said roving end intermediate engaging member and rotatably supported on said temporarily supporting means coaxial to said roving end intermediate engaging member axis, said first and second gears being in meshing engagement with one another, and means for rotatably driving a selected one of said first and second gears to effect synchronous movement of said suction applying means and said roving end intermediate engaging member.

12. In a traveling service unit, the apparatus according to claim 11 and characterized further in that said transferring means includes a post member for receiving a tube of a bobbin inserted thereon for supporting said bobbin.

13. In a traveling service unit, the apparatus according to claim 12 and characterized further in that said transferring means includes means for vertically and laterally moving said post member.

14. In a traveling service unit, the apparatus according to claim 1 and characterized further in that said temporarily supporting means includes means for temporarily supporting a second bobbin, said means including a post member for receiving said second bobbin thereon.

15. In a traveling service unit, the apparatus according to claim 14 and characterized further in that said temporarily supporting means includes means for vertically moving a bobbin temporarily supported thereon.

* * * * *